US006155189A

United States Patent [19]

Walner

[11] Patent Number: 6,155,189

[45] Date of Patent: Dec. 5, 2000

[54] STITCHING GUIDE

[75] Inventor: Hari Walner, Loveland, Colo.

[73] Assignee: Beautiful Publications LLC, Loveland, Colo.

[21] Appl. No.: 09/182,352

[22] Filed: Oct. 29, 1998

Related U.S. Application Data

[60] Provisional application No. 60/063,903, Oct. 31, 1997.

[51] Int. Cl.[7] ..... D05B 35/10; A41H 15/00

[52] U.S. Cl. ..... 112/475.01; 33/13

[58] Field of Search ..... 112/475.01, 475.17, 112/439, 475.08, 475.18, 475.22, 117; 33/13; 428/43; 434/95

[56] References Cited

U.S. PATENT DOCUMENTS

| | | | |
|---|---|---|---|
| 1,560,283 | 11/1925 | Mehlem . | |
| 2,077,772 | 4/1937 | Ring | 33/13 |
| 2,585,946 | 2/1952 | Leberman | 434/95 |
| 2,986,390 | 5/1961 | Kelly . | |
| 3,794,554 | 2/1974 | Caring | 428/43 |
| 4,154,181 | 5/1979 | Massucci et al. . | |
| 4,530,665 | 7/1985 | Colonel . | |
| 4,608,939 | 9/1986 | Lampley . | |
| 4,634,616 | 1/1987 | Musante et al. . | |
| 5,399,410 | 3/1995 | Urase et al. . | |
| 5,650,211 | 7/1997 | Randolph . | |
| 5,832,854 | 11/1998 | Lin et al. | 112/439 X |

OTHER PUBLICATIONS

EZ Quilting Template by EZ International, 85 South St., West Warren, MA 01092.

EZ Quilting Stitch–Thru by EZ International, 95 Mayhill St., Saddle Brook, NJ 07662.

Hari Walner, "Trapunto by Machine," 1996, p. 11, C&T Publishing Lafayette, California.

*Primary Examiner*—Ismael Izaguirre

*Attorney, Agent, or Firm*—Dorr, Carson, Sloan & Birney, P.C.

[57] ABSTRACT

A stitching guide for enabling designs to be stitched onto fabric comprises a flexible sheet into which perforations are cut to form a desired design. The perforations preferably have a predetermined length between about 0.10 inch and about 1 inch (about 0.254 cm and about 2.54 cm), and most preferably between about 0.214 inch and about 0.25 inch (about 0.544 cm and about 0.635 cm). The predetermined width of the perforations is preferably between about 0.01 inch and about 0.08 inch (about 0.0254 cm and about 0.2032 cm). The connectors between the perforations preferably have a predetermined length between about 0.01 inch and about 0.1 inch (about 0.0254 cm and about 0.254 cm). The stitching guide is attached to the fabric, and stitching is sewn along the perforations. When the design is completely stitched, the stitching guide is removed from the fabric by breaking the connectors apart along the line of the perforations.

10 Claims, 3 Drawing Sheets

STITCHING GUIDE

RELATED APPLICATION

This application claims the benefit of U.S. Provisional Application No. 60/063,903, filed Oct. 31, 1997.

BACKGROUND OF THE INVENTION

1. Field of the Invention

The present invention relates generally to providing a stitching guide and, more particularly, to providing a stitching guide for stitching a design onto a piece of fabric.

2. Statement of the Problem

When sewing fabric, it is often desirable to stitch a particular design onto the fabric. This is particularly desirable when sewing a quilt. Such stitching provides a means both for sewing a design on the surface of the fabric or quilt and for attaching together the layers of the quilt "sandwich" (generally made of two layers of fabric with a batting material therebetween). It is also often desirable to repeat the design on more than one portion of the fabric.

It is possible to stitch a design onto a piece of fabric by freehand, but this can be slow and often designs cannot be repeated in other locations if desired. It is also difficult to produce and reproduce an ornate design by this method. To solve these problems, sewers have used various apparatuses and methods to stitch a design into fabric.

For example, on light-colored fabric, a design can be traced on the fabric by placing the fabric over a printed design and tracing the design on the fabric with a marker such as a pen or pencil, or by using a revolving wheel to impress lines into the fabric. The tracing is then sewn over by machine or hand sewing. Once the sewing is completed, however, it is usually necessary to remove the tracing made by pen or pencil from the fabric, and this can be difficult to achieve without leaving permanent marks on the fabric. The impression method has the drawback of being temporary, such that the tracing will often disappear from the fabric before the stitching of the design is completed.

With darker fabrics and fabrics having a simple pattern, a similar method can be utilized by using a light box under the paper with the printed design to enable the design to show through the fabric for tracing. However, it is sometimes difficult to see a tracing of a design on patterned fabric, as no method of marking can be seen on all types of patterned fabrics. The problem of removing the tracing after sewing remains. For very dark fabrics or those with busy patterns, it can sometimes be impossible to see through the fabric in order to trace the design on the fabric, even when using a light box.

To avoid the problem of having to use a light box to mark designs on fabric, a stencil having a design cut into it can be used. Such stencils are conventionally made of fairly stiff plastic with the design cut into the plastic, as exemplified by the "EZ Quilting Template," manufactured by EZ International, 85 South St., W. Warren, Mass. The stencil is laid atop the fabric, and a marker is used to trace the design on the fabric. The fabric can be separate, or it can already be formed into a quilting sandwich before the stencil is applied. Again, there remains the difficulty of removing the markings after sewing over the design. There is also the difficulty of securely attaching the stiff plastic stencil to the fabric, so that it does not slip while the design is traced.

A sewer could also stitch directly through the channels in the stencil. However, the channels are not continuous but are interrupted at frequent intervals by uncut portions, as can be seen in the "EZ Quilting Template." At these uncut portions, the sewer must stop sewing, tie off the thread, and move the needle to the next channel and start sewing again. This is slow and awkward and results in sewn designs with significant gaps along the line of stitching, causing an unaesthetic effect and allowing batting to migrate if the design is being sewn as part of a quilt sandwich. Again, the difficulty of securely yet reversibly attaching the stencil to the fabric may lead to problems such as misplacing of the stitches if the stencil slips while sewing.

Another problem with tracing a design onto the fabric, whether by using a tracing under the fabric or by placing a stencil on the fabric, is the time involved, especially if the design is complicated. This problem is multiplied when a complicated design is repeated many times on the fabric.

Attempts have been made to solve these problems. Sewing guides have been developed that can be attached to pieces of fabric. One such guide is shown in U.S. Pat. No. 4,608,939. The guide disclosed in this patent has an upper unit and a lower unit, which are placed on opposite sides of the fabric to be sewn and clamped together. The upper and lower units have a plurality of perforations through which a needle and thread can be passed through the fabric without at the same time stitching the guide to the fabric. When the sewing is completed, the upper and lower units are removed. The guide disclosed in the '939 patent can only be used with hand sewing, and not with machine sewing.

Another type of sewing guide is shown in U.S. Pat. No. 2,986,390. Here, pieces of fabric to be sewn into a garment are clamped between an upper unit and a lower unit. The lower unit is smaller than the upper unit, so that the edges of the upper unit overlap the edges of the lower unit. The edges of the upper unit have a number of slots cut into them, along which the sewer can stitch a seam. The needle and thread pass through the slot and the underlying fabric, but do not touch the lower unit due to the overlap. This sewing guide is also suitable only for hand sewing. When the seams are sewn, the guide is removed.

As taught by the "EZ Stitch-Thru" system, manufactured by EZ International, 95 Mayhill St., Saddle Brook, N.J., designs can be printed onto sheets of paper that are then attached to the fabric. The sewer stitches along the outline of the design with a threaded needle. After the stitching is completed, the paper is torn away. In a variation of this, as disclosed in the book "Trapunto by Machine," the sewer first stitches along the design with an unthreaded needle, thus puncturing the paper with multiple small holes along the lines of the design. The paper is then attached to the fabric and machine stitched with a threaded needle. When stitching is completed, the paper is torn away along the lines of stitching. However, in both cases it is difficult to remove all the pieces of paper when tearing the sheet away from the fabric after stitching, as the thread tends to capture small portions of the paper underneath the stitches.

It is therefore desirable to provide a stitching guide that enables a design to be sewn on a piece of fabric without having to first mark the design on the fabric. It is also desirable to provide a stitching guide that can be easily attached to the fabric and with which a design can be sewn on the fabric in multiple locations. Hand sewing, especially with complicated designs, can be slow, so being able to use a stitching guide with a sewing machine to sew a design on fabric would also be advantageous. Finally, a stitching guide is needed that can be completely removed from the fabric after the design is sewn.

3. Solution to the Problem

The present invention solves these problems by providing a stitching guide comprising a flexible sheet of material such as relatively thin paper. A design is placed in the flexible sheet by cutting perforations of a predetermined size into the flexible sheet. The stitching guide is easily attached to any type of fabric by using, for example, straight pins or other conventional means of attachment. The design is then stitched onto the fabric by hand stitching or with a sewing machine by directing the needle to follow along the perforations cut into the stitching guide. The stitching guide is then easily removed from the fabric by tearing the flexible sheet apart along the line of the perforations without leaving any traces.

SUMMARY OF THE INVENTION

The present invention provides a stitching guide comprising a flexible sheet that has cut into it a plurality of perforations of a predetermined size. The stitching guide is preferably made of relatively thin paper; however, it is to be understood that the stitching guide can be comprised of any relatively thin flexible material, for example, plastic or non-woven fabric.

The stitching guide can be easily attached to any type of fabric. For example, the stitching guide can be attached by using pins or other types of attaching devices, or the stitching guide could be attached to the fabric with a pressure-sensitive or contact adhesive.

The plurality of perforations cut into the flexible sheet are preferably arranged in a desired design. Such a design can be a simple one or a more complex design. In the preferred embodiment, the perforations have a predetermined shape in which they are generally longer than they are wide. For example, the perforations may be rectangular or oval in shape. In a preferred embodiment the perforations have a predetermined size of between about 0.10 inch and about 1 inch long and between about 1 inch (about 0.254 cm and about 2.54 cm and about 0.08 inch (about 0.0254 cm and about 0.0163 cm) inch wide. In a highly preferred embodiment, the perforations have a predetermined length of between about 0.214 inch and about 0.25 inch (about 0.544 cm and about 0.635 cm) inch. The connectors between the perforations preferably have a length between about 0.1 inch (about 0.0254 cm and about 0.254 cm) inch and about 0.1 inch.

This predetermined size of the perforations and of the connectors enables the operator to place a stitched design on the fabric to which the stitching guide is attached by guiding a needle and thread through the perforations by hand or machine stitching. With larger and more complicated designs, the stitching is preferably done with a sewing machine by directing the needle to follow along the perforations in the stitching guide.

After the design is stitched, the stitching guide is easily removed from the fabric by being torn away along the perforations without leaving any traces behind on the fabric. The predetermined size of the connectors enables the flexible sheet forming the stitching guide to be torn by breaking the connectors along the line of the perforations.

These and other advantages, features, and objects of the present invention will be more readily understood in view of the following detailed description and the drawings.

DETAILED DESCRIPTION OF THE INVENTION

Figure 1B:
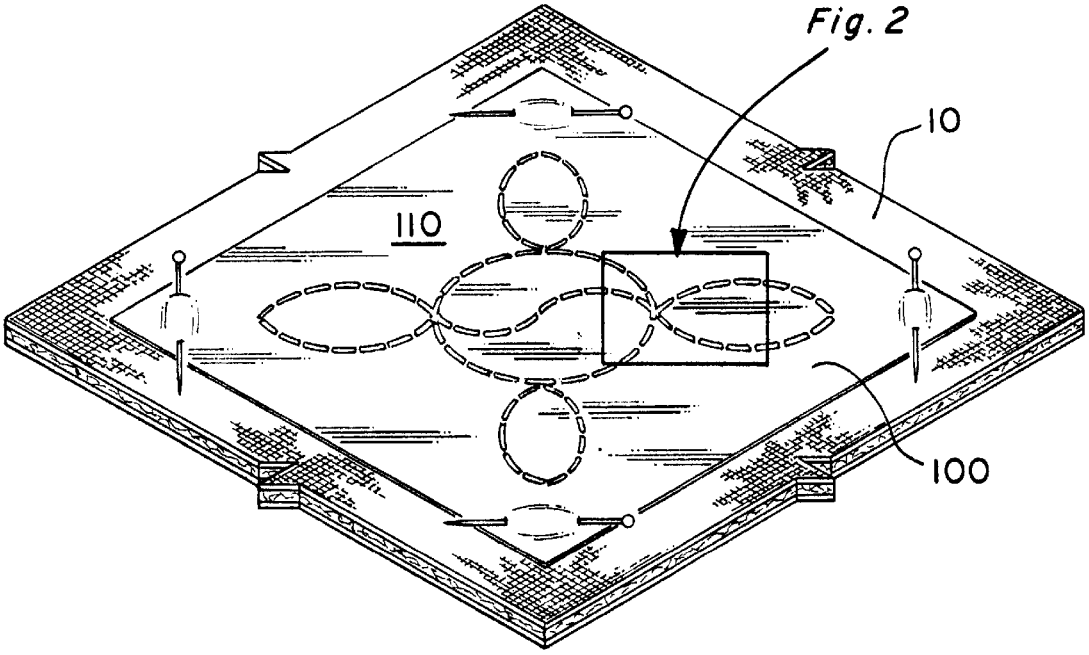
FIGS. 1*a* and 1*b* are perspective views showing how the stitching guide of the present invention is attached to a piece of fabric in a quilting sandwich.
Figure 1A:
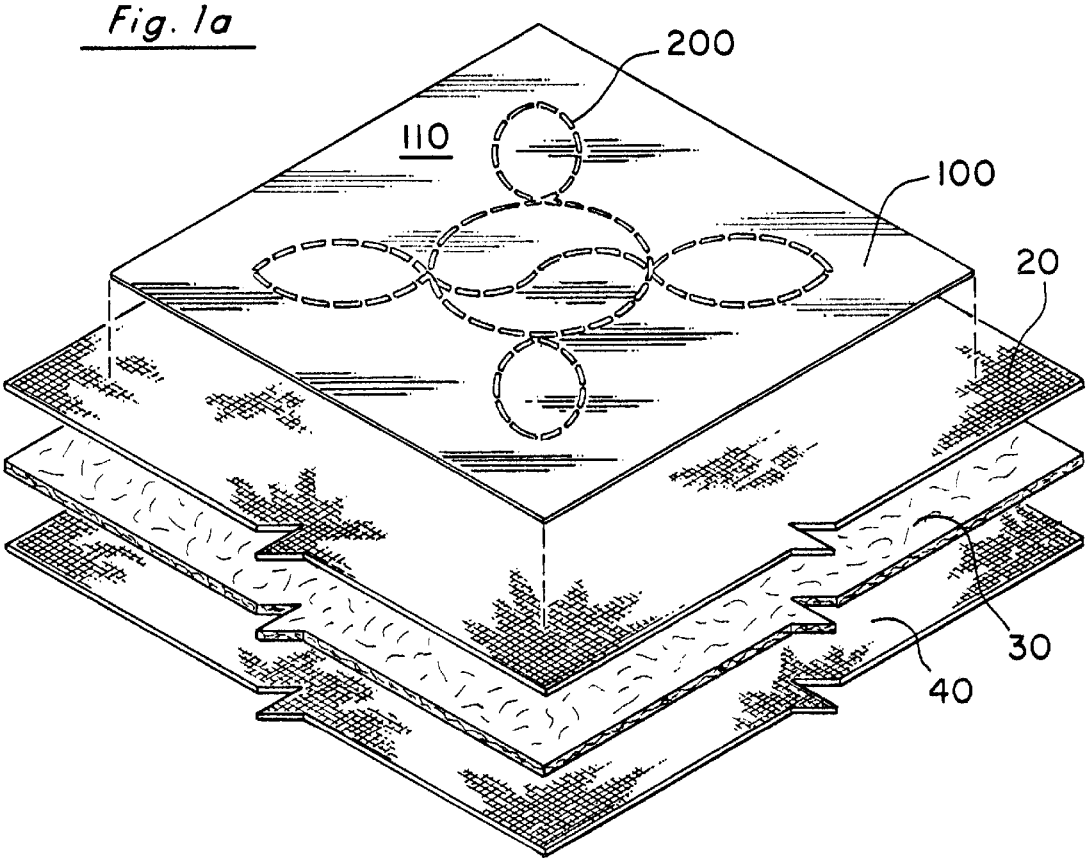

A stitching guide 100 of the present invention is illustrated in FIGS. 1*a* and 1*b*. In FIGS. 1*a* and 1*b*, the stitching guide 100 is shown being attached to a piece of fabric 20 that is a portion of a "quilting sandwich" 10, which is shown in exploded form in FIG. 1*a* and in compressed form in FIG. 1*b*. The quilting sandwich 10 is conventionally formed of three layers, a top layer 20 of fabric, a middle layer 30 of batting, and a bottom layer 40 of fabric. The fabric of the top 20 and bottom 40 layers is preferably cotton, but any conventional fabric can be used. The batting 30 can be relatively thin, as shown in FIG. 1*a*, or can be of various thicknesses as desired by the quilter.

Although the stitching guide 100 in FIGS. 1*a* and 1*b* is illustrated in conjunction with a quilting sandwich 10, it should be understood that the stitching guide 100 can be used with any piece of fabric 20 on which a design is to be stitched, and that the present invention is not limited by any particular description made herein, but only by the claims.

The stitching guide 100 in a preferred embodiment is a flexible sheet 110 made of a material that is sturdy enough to attach to the fabric 20 and withstand other types of manipulation yet thin enough to be easily removed from the fabric 20 after stitching is completed as described below. In a preferred embodiment, the stitching guide 100 is preferably formed of a relatively thin paper. It will be obvious to those skilled in the art that substances other than paper can be used to form the stitching guide 100, for example, a thin plastic-type material or a light-weight nonwoven fabric. The aspects of the material forming the stitching guide 100 that are important to the present invention are flexibility, strength, case of perforation, and the ability to be easily removed from the fabric 20 after a design is stitched on the fabric 20.

Figure 2:
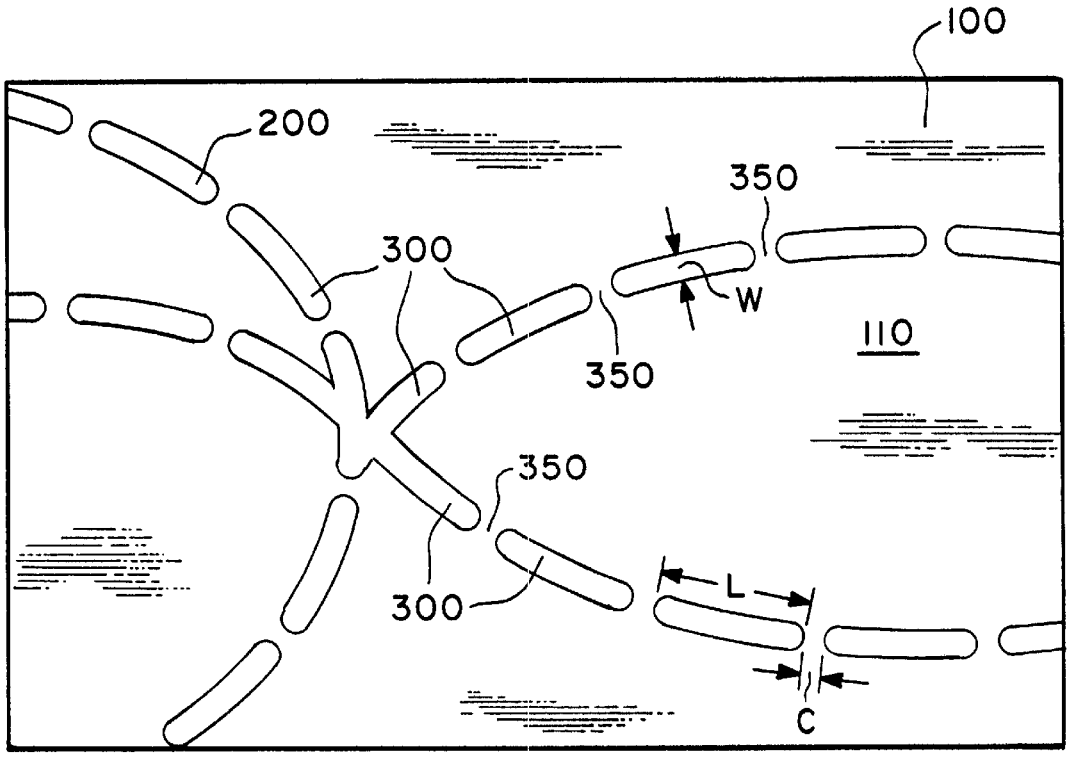
FIG. 2 is a partial close-up of the top of a stitching guide of the present invention.

In a preferred embodiment, a design 200 is placed in the stitching guide 100 by cutting a plurality of perforations 300 in the flexible sheet 110, as can be seen more easily in FIG. 2. The perforations 300 are generally longer than they are wide, and are placed end to end along the entire design (as shown in FIG. 1*a*). After the perforations 300 are cut out of the flexible sheet 110, "connectors" 350 remain between the perforations 300. Connectors 350 are defined herein as portions of the flexible sheet 110 between the ends of the perforations 300 that are not removed when the perforations 300 are cut into the sheet 110.

Any type of design 200 desired can be cut into the stitching guide 100 so long as a sufficient number of connectors 350 remain to hold the material of the flexible sheet 110 together. In a preferred embodiment, designs 200 are used that can be stitched with a sewing machine continuously from a starting point to a stopping point without having to stop and tie off the thread or overstitch any portions. Such a design 200 is illustrated in FIG. 1*a*.

The perforations 300 are cut into the stitching guide 100 by several methods. In a preferred embodiment, a laser cutting machine is used to cut the perforations 300. Up to ten flexible sheets 110 are stacked together and placed in the laser cutting machine. The laser burns each perforation 300 through the entire stack, providing a sharp, clean-edged cut. It is preferable to use a laser to cut the perforations 300 because of the small size of the perforations 300 and the large number of perforations 300 that must be cut for each design 200, many of which are more complicated than illustrated herein. When using a laser to cut the perforations 300, the design 200 can be drawn onto the top sheet 110, or an image can be projected onto the sheet 110 with a conventional projector, or the design 200 can be scanned into a computer and the digital image transferred to a computer that runs the laser. Other methods of indicating to the laser how to cut the design 200 into the sheet 110 will be obvious to those skilled in the art.

In an alternative embodiment, the perforations 300 are cut into the stitching guide 100 by use of a die that punches out each perforation 300. In this alternative method, more than one sheet 110 can be perforated at one time. In another embodiment, the perforations 300 are cut by hand by using a double-edged knife, such as the knives made by the X-Acto Company. A further method by which the perforations 300 can be cut into the stitching guide 100 involves the use of milling, in which a router is used to perforate compressed stacks of sheets 110. It is to be understood that other methods can be used for cutting the perforations 300 into the stitching guide 100, as will be evident to those skilled in the art, and that the present invention is not meant to be limited by any particular description found herein.

After the perforations 300 are cut into the stitching guide 100, the stitching guide 100 is attached securely to the fabric 20 by any conventional method desired, for example, by use of straight pins as shown in FIG. 1*b* or safety pins or contact adhesive. The method of attachment is not important to the present invention; the stitching guide 100 can be attached to the fabric 20 by any method that provides a secure yet removable fastening that will hold the stitching guide 100 firmly in place during the subsequent steps of stitching and leave little to no trace when the stitching guide 100 is removed.

Figure 3:
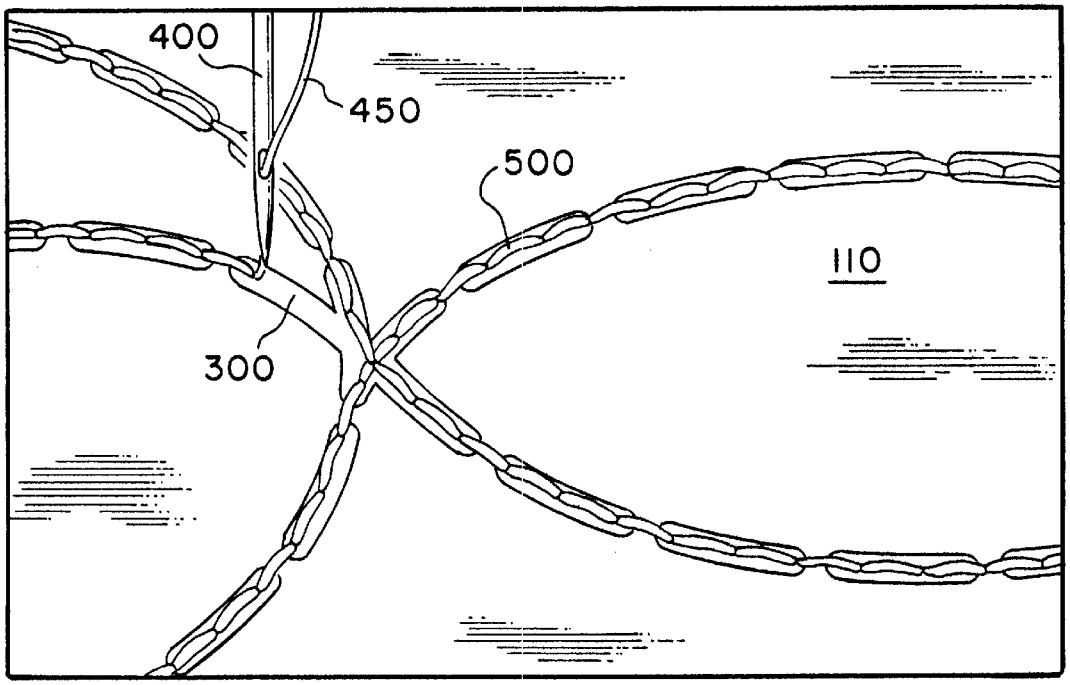
FIG. 3 shows the stitching guide of FIG. 2 as stitches are being made.

After the stitching guide 100 is attached to the fabric 20, the design 200 is stitched into the fabric 20 by hand stitching or, more preferably, by using any conventional sewing machine or a long-arm commercial quilting machine, as shown in FIG. 3. The needle 400 is placed over the perforations 300 and directed along the length of the path formed by the perforations 300. As the needle 400 moves along the path of perforations 300, the thread 450 is stitched into the fabric 20. The size of the stitches 500 may vary, but preferably the length of each stitch 500 is shorter than the length of a perforation 300. Thus, occasional stitches 500 are put into or across the connectors 350 as the design 200 is stitched.

Figure 4:
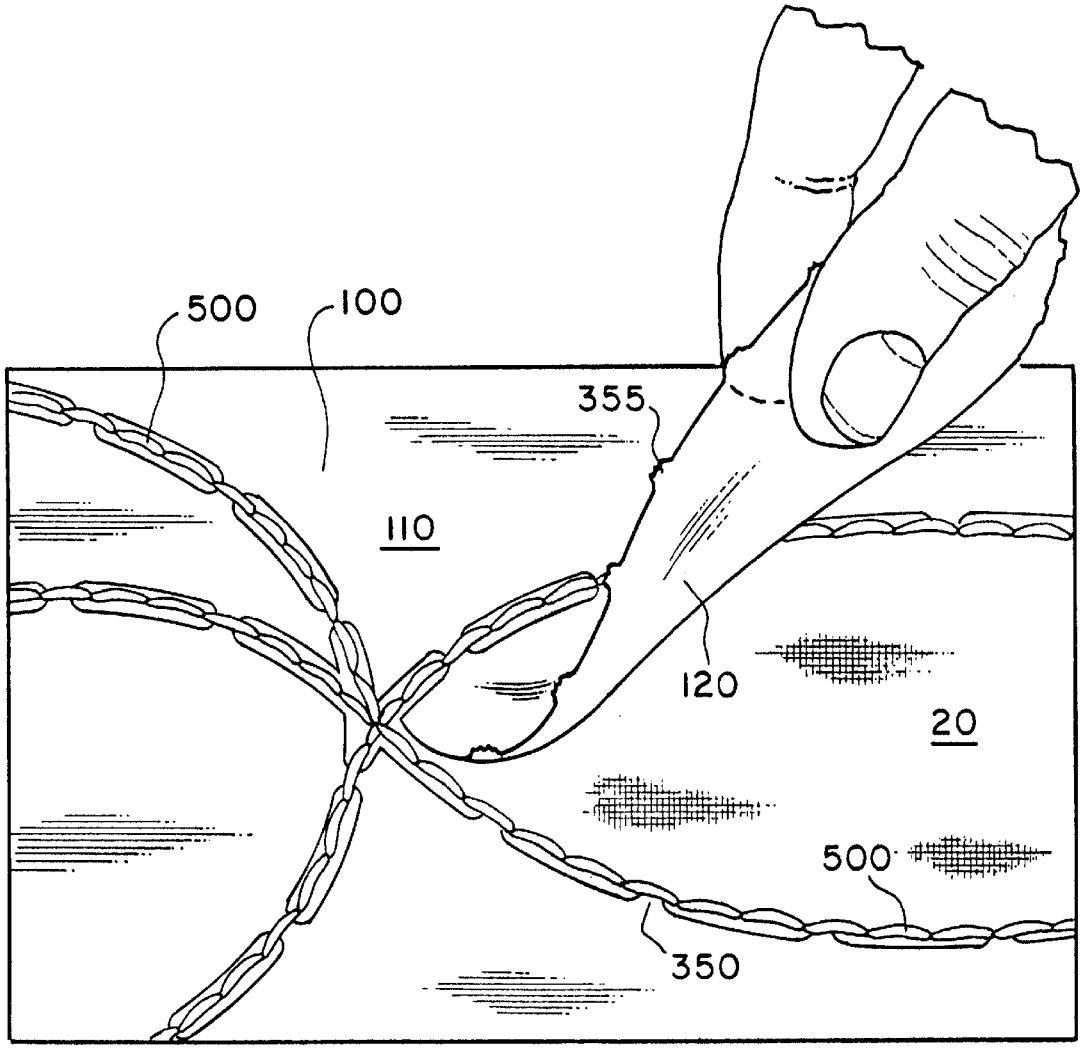
FIG. 4 illustrates the removal of the stitching guide of FIG. 3 after stitching is completed.

After the design 200 has been stitched into the fabric 20, the stitching guide 100 must be removed from the fabric 20, as illustrated in FIG. 4. The sizes of the perforations 300 and connectors 350 are predetermined to enable the stitching guide 10 to be removed from the fabric 20 by being torn away, as shown in FIG. 4, yet to prevent the stitching guide 100 from falling into pieces when the perforations 300 are cut into the stitching guide 100. To achieve these objectives, it is necessary for the perforations 300 and connectors 350 to be within a particular predetermined range of sizes. If the perforations 300 arc too long, the stitching guide 100 will fall apart. If the connectors 350 are too long, the stitching guide 100 will be difficult to remove from the fabric 20 after the sewing is completed.

For example, in a preferred embodiment of the invention, the perforations 300 have a predetermined length "L", as shown in FIG. 2, of between about 0.10 inch and about 1 inch (about 0.254 cm and about 2.54 cm). The length "L" of the perforations 300 is determined to some extent by the type of design 200 that is cut into the stitching guide 10. For example, in simpler designs, a longer perforation 300 (up to about 1 inch (2.54 cm) can be used. In a highly preferred embodiment, each perforation 300 is between about 0.214 inch and about 0.25 inch (about 0.544 cm and about 0.635 cm) long. The predetermined width "W" of the perforations 300 preferably ranges between about 0.01 inch and about 0.08 inch (about 0.0254 cm and about 0.203 cm). The predetermined length "C" of the connector portions 350 preferably ranges between about 0.01 inch and about 0.1 inch.

After the design 200 is stitched into the fabric 20, the stitching guide 100 is removed by pulling the stitching guide 100 away from the fabric 20 as shown in FIG. 4. As each portion 120 of the stitching guide 100 is pulled away, the connectors 350 between the perforations 300 break 355 apart along the perforations 300 and the line of stitches 500. Because of the large ratio L/C (between about 1 and about 100) of the length "L" of the perforations 300 to the length "C" of the connectors 350, the connectors 350 break away cleanly, leaving no pieces of the flexible sheet 110 caught in the stitches 500. In those instances where stitches 500 have gone through connectors 350, the connectors 350 may already have broken 355, making it even easier to tear the stitching guide 100 from the fabric 20. The thickness of the material forming the stitching guide 100 has some bearing on this. A thicker material will be more likely to leave behind small pieces caught in the stitches 500. Thus, the material used in a preferred embodiment of the invention, as described above, is relatively thin.

After the stitching guide 100 is removed from the fabric 20, it is disposed of, and nothing further needs to be done to the fabric 20, for example, to remove tracings, etc., as in the prior types of design transfer methods.

The above disclosure sets forth a number of embodiments of the present invention. Other arrangements or embodiments, not precisely set forth, could be practiced under the teachings of the present invention and as set forth in the following claims.

I claim:

1. A stitching guide comprising:

a single flexible sheet having a plurality of perforations therein, said perforations having a predetermined length L and a predetermined width, said plurality of perforations forming a design; and a plurality of connectors between said plurality of perforations, said connectors having a predetermined length C;

wherein the ratio L/C is between about 1 and about 100; and wherein stitches are put into both said perforations and said connectors.

2. The stitching guide of claim 1, wherein said plurality of perforations each has a predetermined length L between about 0.1 inch (about 0.254 cm) and about 1 inch (about 2.54 cm) and a predetermined width between about 0.01 inch (about 0.0254 cm) and about 0.08 inch (about 0.203 cm).

3. A stitching guide comprising:

a single flexible sheet having a plurality of perforations therein, said plurality of perforations each having a predetermined length between about 0.1 inch (about 0.254 cm) and about 1 inch (about 2.54 cm) and a predetermined width between about 0.01 inch (about 0.0254 cm) and about 0.08 inch (about 0.2032 cm); and a plurality of connectors between said plurality of perforations, said connectors having a predetermined length between about 0.01 inch (about 0.0254 cm) and about 0.1 inch (about 0.254 cm);

wherein stitches are put into both said perforations and said connectors.

4. A stitching guide comprising:

a single flexible sheet having a plurality of perforations therein, said plurality of perforations each having a predetermined length between about 0.1 inch (about 0.254 cm) and about 1 inch (about 2.54 cm) and a predetermined width between about 0.01 inch (about 0.0254 cm) and about 0.08 inch (about 0.2032 cm); and a plurality of connectors between said plurality of perforations, said connectors having a predetermined length between about 0.01 inch (about 0.0254 cm) and about 0.1 inch (about 0.254 cm);

wherein stitches pass through both said perforations and said connectors and wherein said plurality of perforations each has a predetermined length between about 0.214 inch (about 0.544 cm) and about 0.25 inch (about 0.635 cm).

5. A stitching guide comprising:

a single flexible sheet having a plurality of perforations therein, said plurality of perforations each having a predetermined length between about 0.1 inch (about 0.254 cm) and about 1 inch (about 2.54 cm) and a predetermined width between about 0.01 inch (about 0.0254 cm) and about 0.08 inch (about 0.2032 cm); and a plurality of connectors between said plurality of perforations, said connectors having a predetermined length between about 0.01 inch (about 0.0254 cm) and about 0.1 inch (about 0.254 cm);

wherein stitches pass through both said perforations and said connectors and wherein said plurality of perforations each has a predetermined length between about 0.214 inch (about 0.544 cm) and about 0.25 inch (about 0.635 cm) and wherein said plurality of perforations forms a design.

6. A method of sewing a design on fabric comprising the steps of:

providing a flexible sheet;

cutting a plurality of perforations having a predetermined length between about 0.1 inch (about 0.254 cm) and about 1 inch (about 2.54 cm) in said flexible sheet, said plurality of perforations forming a design;

attaching said flexible sheet having said plurality of perforations to a piece of fabric;

stitching along said plurality of perforations; and removing said flexible sheet by tearing it along said plurality of perforations.

7. The method of claim 6 wherein said plurality of perforations each has a predetermined length between about 0.214 inch (about 0.544 cm) and about 0.25 inch (about 0.635 cm).

8. A stitching guide comprising:

a flexible sheet having a plurality of perforations therein, said perforations having a predetermined length L and a predetermined width; and a plurality of connectors between said plurality of perforations, said connectors having a predetermined length C, wherein the ratio L/C is between about 1 and about 100;

wherein said plurality of perforations each has a predetermined length L between about 0.214 inch (about 0.544 cm) and about 0.25 inch (about 0.635 cm) and a predetermined width between about 0.01 inch (about 0.0254 cm) and about 0.08 inch (about 0.203 cm).

9. A stitching guide comprising:

a flexible sheet having a plurality of perforations therein, said perforations having a predetermined length L and a predetermined width; and a plurality of connectors between said plurality of perforations, said connectors having a predetermined length C, wherein the ratio L/C is between about 1 and about 100;

wherein said plurality of perforations each has a predetermined length L between about 0.214 inch (about 0.544 cm) and about 0.25 inch (about 0.635 cm) and a predetermined width between about 0.01 inch (about 0.0254 cm) and about 0.08 inch (about 0.203 cm) and wherein said plurality of connectors each has a predetermined length C between about 0.01 inch (about 0.0254 cm) and about 0.1 inch (about 0.254 cm).

10. A method of sewing a design on fabric comprising the steps of:

providing a flexible sheet;

cutting a plurality of perforations in said flexible sheet, said plurality of perforations each having a predetermined length between about 0.214 inch (about 0.544 cm) and about 0.25 inch (about 0.635 cm), said plurality of perforations forming a design;

attaching said flexible sheet having said plurality of perforations to a piece of fabric;

stitching along said plurality of perforations; and removing said flexible sheet by tearing it along said plurality of perforations.

* * * * *